US009087661B2

(12) United States Patent
Koepsell

(10) Patent No.: US 9,087,661 B2
(45) Date of Patent: Jul. 21, 2015

(54) ELECTRICAL SWITCH ARRANGEMENT

(71) Applicant: Johnson Electric S.A., Murten (CH)

(72) Inventor: Martin Koepsell, Ennepetal (DE)

(73) Assignee: JOHNSON ELECTRIC S.A., Murten (CH)

( * ) Notice: Subject to any disclaimer, the term of this patent is extended or adjusted under 35 U.S.C. 154(b) by 182 days.

(21) Appl. No.: 13/849,288

(22) Filed: Mar. 22, 2013

(65) Prior Publication Data

US 2013/0248339 A1 Sep. 26, 2013

(30) Foreign Application Priority Data

Mar. 23, 2012 (DE) ..... 10 2012 005 960

(51) Int. Cl.
*H01H 13/20* (2006.01)
*H01H 13/02* (2006.01)
*H01H 13/56* (2006.01)

(52) U.S. Cl.
CPC ..... *H01H 13/20* (2013.01); *H01H 13/023* (2013.01); *H01H 13/562* (2013.01)

(58) Field of Classification Search
CPC .... H01H 13/20; H01H 13/562; H01H 13/023
USPC ..... 200/524, 523, 520, 310–314, 341
See application file for complete search history.

(56) References Cited

U.S. PATENT DOCUMENTS

| | | | | | |
|---|---|---|---|---|---|
| 3,542,988 | A * | 11/1970 | Baldasare | ..... | 200/305 |
| 3,776,049 | A * | 12/1973 | Emery | ..... | 74/110 |
| 4,096,368 | A * | 6/1978 | Grebner | ..... | 200/314 |
| 4,447,685 | A * | 5/1984 | Ohashi et al. | ..... | 200/439 |
| 6,335,500 | B1 * | 1/2002 | Chi et al. | ..... | 200/341 |

FOREIGN PATENT DOCUMENTS

| | | |
|---|---|---|
| DE | 2715063 | 11/1977 |
| DE | 292106 | 7/1991 |
| DE | 19740478 | 3/1999 |
| EP | 2148342 | 1/2010 |
| GB | 2108324 | 5/1983 |

* cited by examiner

*Primary Examiner* — Edwin A. Leon
(74) *Attorney, Agent, or Firm* — Muncy, Geissler, Olds & Lowe, P.C.

(57) ABSTRACT

An electrical switch arrangement has a switch housing and a button guided in the switch housing. The button can be brought into two fixed switching states. A display indicates when at least one of the switching states is reached. A U-shaped spring is arranged inside the button approximately at right angles to the direction of movement the button. The spring is guided in a guide track formed in sections of the switch housing.

18 Claims, 4 Drawing Sheets

ELECTRICAL SWITCH ARRANGEMENT

CROSS REFERENCE TO RELATED APPLICATIONS

This non-provisional patent application claims priority under 35 U.S.C. §119(a) from Patent Application No. 102012005960-4 filed in Germany on Mar. 23, 2012, the entire contents of which is incorporated herein by reference.

FIELD OF THE INVENTION

This invention relates to an electrical switch arrangement and in particular, to a switch having two fixed switching states and a display which shows when at least one of the switching states has been reached.

BACKGROUND OF THE INVENTION

Such electrical switching arrangements are used for a variety of purposes, for example in automobiles in which when a switch is operated the driver and/or the front passenger must be able to see that it has been operated. Examples of such include a switch for the electric rear windscreen heater or also a switch for the hazard warning lights system. With these switches, a switching state is indicated by a visual display, and this visual display signals that this switching state has been reached.

The button guided in the switch housing may be put into two fixed switching states, in one switching state an electrical circuit is closed, and in the other switching state the electrical circuit is open. Such a button may be in the form of a pushbutton or a pull-button or also a rotating button.

Electrical switching arrangements that use a guide track in the form of a heart-shaped curve to produce at least one fixed switching state are known from the prior art. A spring that is in operative connection with the button is guided in this heart-shaped curve, and the spring is often guided not only along the track curves, but also over ramps. The ramps have a gradual upward incline on one side, so that a portion of the spring is able to slide over it, but at the end of the ramp there is a sharp drop to a lower level, and noises are generated when the spring passes over this ramp and descends to the lower level. The spring is guided in three dimensions, and it also functions as a resonance amplifier.

In addition, the alignment of the spring is usually vertical according to the prior art, such that the switch known for example from DE 197 14 163 C2 is a relatively high structure. The greater structural height is often awkward in many operational uses, where the installation space is extremely limited.

Hence there is a desire for an electrical switch arrangement, which enables safe switching with lower installed height and reduced noise generation. At the same time, the reliable display of a switching state should not be obstructed.

SUMMARY OF THE INVENTION

This desire is satisfied by the present invention in that a spring is arranged inside the button approximately at right angles to the direction of movement the button, wherein the spring is guided in a guide track in sections of the switch housing.

In the switch arrangement according to the invention, the spring is not aligned vertically when the button has the form of a pushbutton. The pushbutton describes a linear motion within the switch housing, and the spring is aligned at right angles to this motion. Accordingly, the spring is aligned transversely to the direction of motion of the button, so that it is possible to reduce the structural height. The spring protrudes into a guide track that is located in the switch housing. The button may be moved along this guide track via the spring, the guide track being shaped in known manner such that the button is able to be moved into fixed switching states and consequently assumes different switching states.

According to a first refinement of the invention, it is provided that the guide track is a heart-shaped curve. The spring is able to assume positions in the convex sections of the heart-shaped curve that differ from each other. Height differences in this heart-shaped curve with ramps or similar three-dimensional contours are not provides, so that the spring is guided purely in two dimensions. This results in minimal noise generation.

According to a subsequent refinement of the invention, it is provided that the spring has the form of a wire section that is curved into an approximate U-shape and is retained in the pushbutton in the region of its base, and of which the free end of one leg of the U-shape protrudes into the guide track. The spring thus has the form of a wire section that is curved or bent into a U-shape and is aligned at right-angles to the direction of sensing motion of the button. The two legs of the U-shaped spring thus lie in the same plane and are perpendicular to the direction of sensing motion. The spring is retained in the pushbutton, this is assured according to this refinement by the base of the U-shaped spring. Since it is fixed in this region, it is thus possible for at least one of the legs of the U-shape to move, particularly the leg whose free end protrudes into the guide track. The middle section of this protruding leg of the U-shape preferably lies flush against one side of a projection of the pushbutton so that the free end may be deflected to the left or right by applying a deflection force in the plane of the two legs of the U-shape, and these deflections to the left and right are used for moving along the guide track when the button is operated. The other leg of the U-shaped spring may lie flush against other sections of the button.

According to a subsequent refinement of the invention, it is provided that the protruding leg of the U-shape is under no tension in one switched state and may be deflected along the guide track as a result of the button movement.

To create a further variation of the switch arrangement, according to a refinement of the invention it may be provided that a resilient switching mat is arranged inside the housing. When operated, the button may be pressed towards the switching mat, and the switching mat may be configured to allow inward spring deflection more easily than outward spring deflection. This may also create desirable haptics by making rapid switching possible, after which the switch returns softly to its starting position when it is released again. A compression spring or other spring component may also be provided instead of a resilient switching mat.

The button with the spring preferably acts on a switch component. With the button, the switching force is transmitted to the actual switch component with which the electrical circuit is opened and closed. According to a refinement of the invention, it is provided that the switch component is arranged on a foil that extends into the switch housing. The switching component may be located directly on the foil, thus enabling structural heights to be reduced to a minimum. This in turn enables a further reduction in the structural height of the switch arrangement as a whole. The foil extends into the switch housing and thus participates directly in the formation of the switch arrangement with its electrical conductors.

Preferably, the switch housing may be of two-part construction, wherein a component with the guide track is fastened to a base component. In addition, at least one light source may be arranged inside the switch housing, for this purpose it is provided that at least the button and at a switching mat if present are manufactured from a translucent material. The button and the switching mat may be manufactured from a transparent or translucent material so that the light is able to pass through them, and preferably also that the light may be distributed evenly. Particularly when the light is distributed evenly, the spring arranged in the switch housing for assuming different switching states does not represent an obstruction for creating the light path. Preferably, the light source may be an LED arranged on the foil, this also helps to further reduce the structural height. The components of the switch arrangement may also be simplified generally as the absence of need to guide light through perforations or channels means that the construction of the individual components may be simpler in this context.

The switching mat may be positioned directly on top of the foil. This results advantageously in a denser construction of the foil section with the switch component.

To realise a further variant of the invention, it may also be provided that the button is furnished with a cap. This cap may be furnished for example with a symbol indicating the functioning of the electrical circuit with the button.

BRIEF DESCRIPTION OF THE DRAWINGS

A preferred embodiment of the invention will now be described, by way of example only, with reference to figures of the accompanying drawings. In the figures, identical structures, elements or parts that appear in more than one figure are generally labeled with a same reference numeral in all the figures in which they appear. Dimensions of components and features shown in the figures are generally chosen for convenience and clarity of presentation and are not necessarily shown to scale. The figures are listed below.

DETAILED DESCRIPTION OF THE PREFERRED EMBODIMENTS

Figure 1:
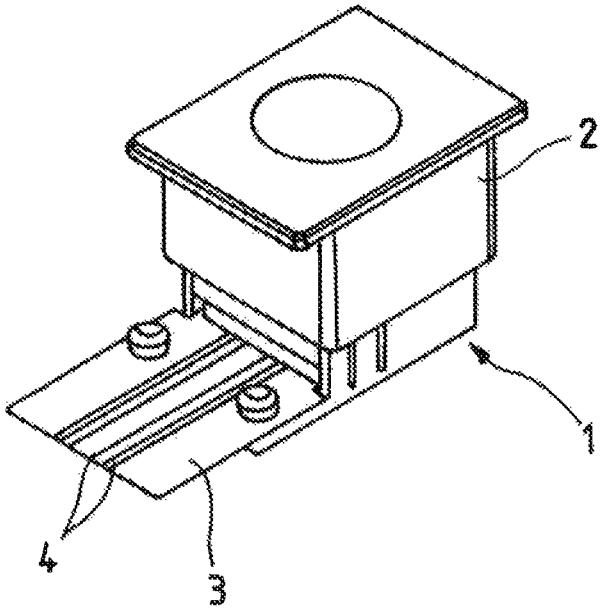
FIG. 1 is a perspective view of an electrical switch arrangement according to the invention.

The switch arrangement of FIG. 1 comprises a switch housing 1 and a cap 2. Cap 2 may be modified according to customer requirements, it may be furnished with perforations or translucent portions to allow the light from a light source arranged inside switch housing 1 to pass through.

A foil 3 including electrically conductive pathways 4 extends into the interior of switch housing 1.

Figure 2:
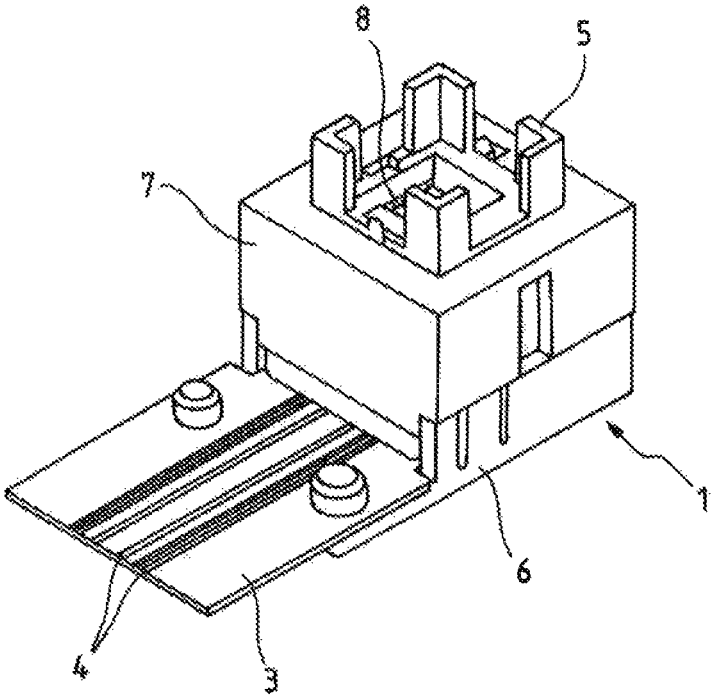
FIG. 2 is another perspective view of the switch arrangement of FIG. 1 with a cap removed.

When cap 2 is removed, as shown in FIG. 2, It can be seen that cap 2 is placed over a button 5. Button 5 is guided inside switch housing 1, and is able to assume two fixed switching states. Switch housing 1 is made from a base component 6 and another component 7 that is fastened on top of base component 6 and has a guide track 13. A spring 8 is inserted into button 5.

Figure 3:
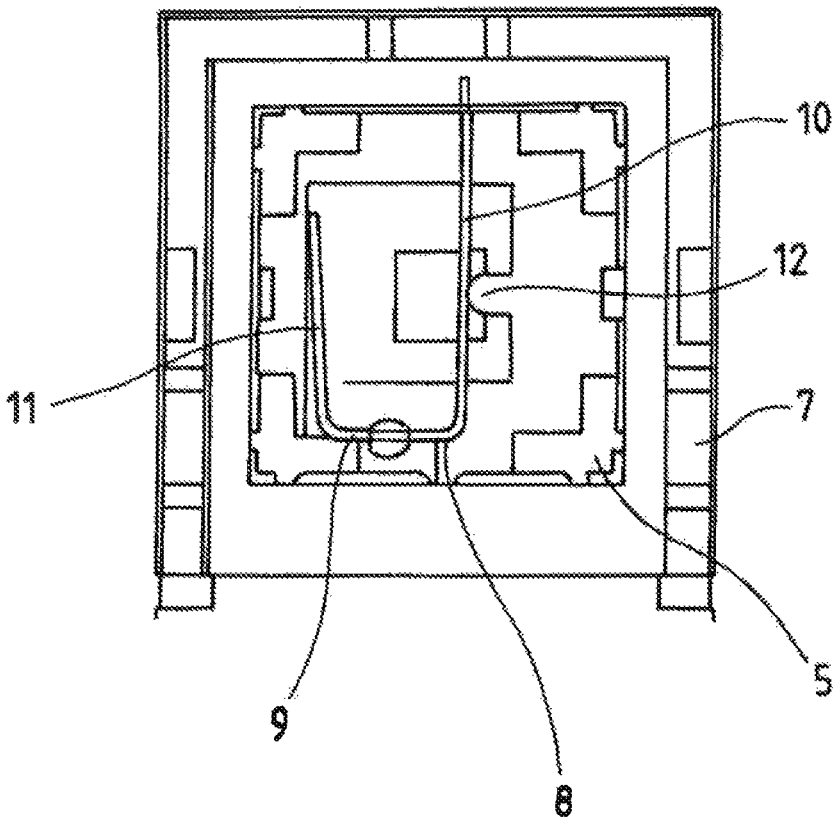
FIG. 3 is a top view of the switch arrangement of FIG. 2.

FIG. 3 shows spring 8. It is configured as a section of wire bent into a U-shape, it has a U-base 9, a protruding U-leg 10 and another U-leg 11. U-base 9 is attached fixedly to button 5. Protruding U-leg 10 lies flush against one side of a prominence 12 of button 5. The. other U-leg 11 lies flush against other sections of button 5.

Figure 5:
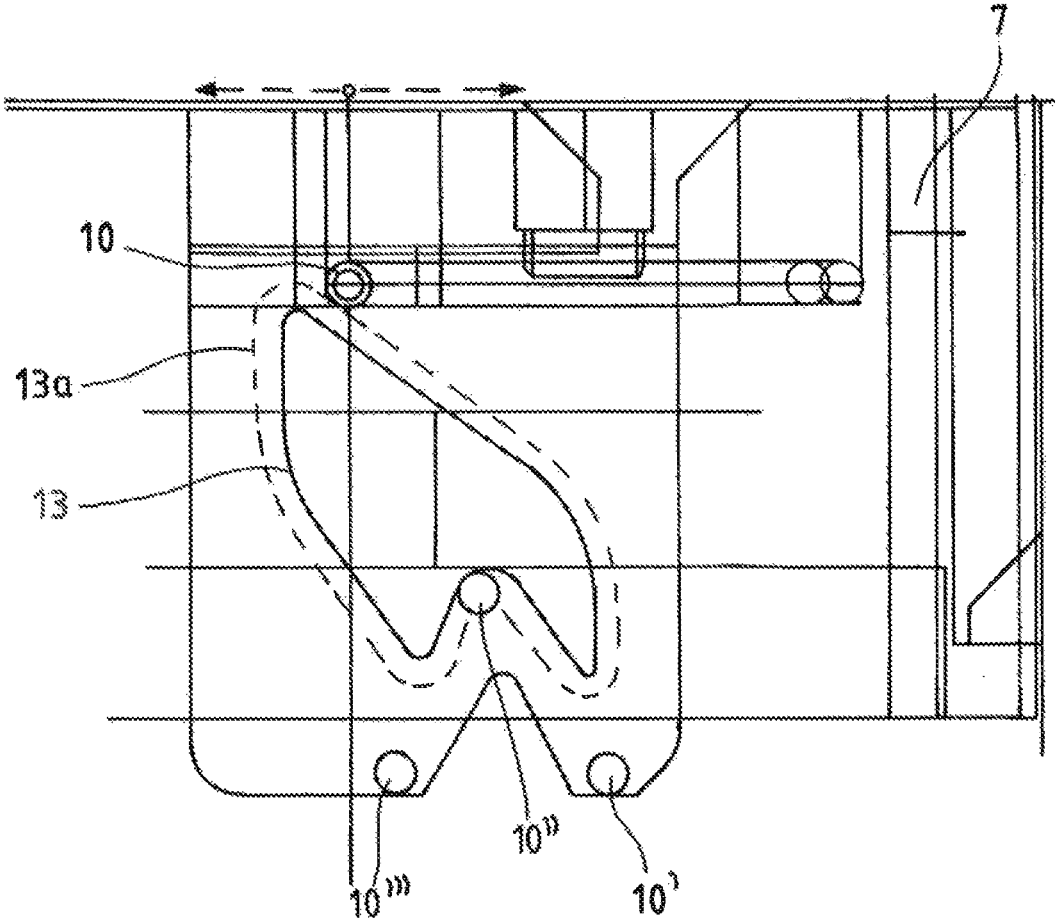
FIG. 5 is a diagrammatic side view of a component of the switch arrangement of FIG. 2 drawn to a larger scale.

The free end of protruding U-leg 10 protrudes out of button 5 and into component 7 with guide track 13. FIG. 5 shows this guide track 13, and 13*a* with a dashed line, and various positions of protruding U-shaped leg 10', 10", 10''' while button 5 is moving.

In FIG. 5, protruding U-leg 10 is first shown in a position in which the electrical switch arrangement is in the OFF position. As button 5 moves downwards in component 7 with guide track 13, the protruding end of U-leg 10 travels along guide track 13 and reaches a predefined position at 10" in which the electrical switch arrangement is switched on. To switch it off, all that is needed is to press button 5 again to bring U-leg 10 to position 10", then when button 5 is released U-leg 10 is guided along the left flank of guide track 13 until it regains its starting position 10. In its starting position U-leg is under no load. Resetting forces arc generated when U-leg 10 is deflected to the right or the left.

Figure 4:
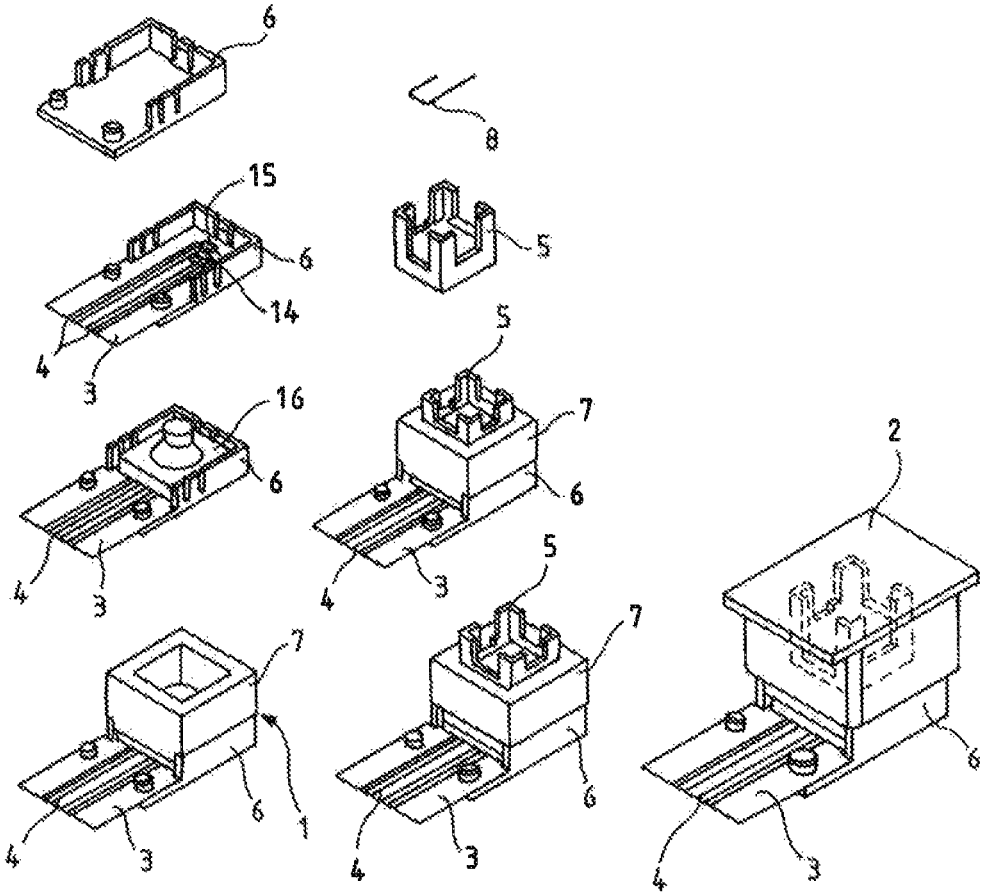
FIG. 4 is an exploded schematic illustration of the components of the switch arrangement of FIGS. 2 and 3, in various stages of assembly.

FIG. 4 shows the individual components of the electrical switch arrangement. First, foil 3 with conductive pathways 4 is introduced into base component 6. Conductive pathways 4 lead to a switch component 14 and an LED 15 as the light source. Switch component 14 is actuated with a switching mat 16, wherein button 5 acts on switching mat 16. Component 7 with the guide track is placed on top of base component 6 to complete the assembly of switch housing 1.

Button 5 is a separate component in which spring 8 inserted. The two legs 10, 11 of the U-shaped spring 8 extend in the same plane perpendicularly to the direction of sensing motion of button 5. Switching mat 16 and component 7 with guide track 13 as well as button 5 may be manufactured from transparent materials to enable the light from LED 15 to reach the cap 2 placed on top of button 5.

In the description and claims of the present application, each of the verbs "comprise", "include", "contain" and "have", and variations thereof, are used in an inclusive sense, to specify the presence of the stated item but not to exclude the presence of additional items.

Although the invention is described with reference to one or more preferred embodiments, it should be appreciated by those skilled in the art that various modifications are possible. Therefore, the scope of the invention is to be determined by reference to the claims that follow.

The invention claimed is

1. An electrical switch arrangement, comprising:

a switch housing;

at least one button guided in the switch housing, the button being movable between two fixed switching states;

a display indicating when at least one of the switching states is reached; and a spring arranged inside the button at right angles to the direction of movement of the button, wherein the spring is guided in a guide track formed in sections of the switch housing, wherein the button moves with the spring when the spring moves along the guide track.

2. The switch arrangement of claim 1, wherein the guide track is in the form of a heart-shaped curve.

3. The switch arrangement of claim 1, wherein the spring is a piece of wire bent into a U-shape, which is held inside the button in the region of its U-base and of which the free end of one U-leg protrudes into the guide track.

4. The switch arrangement of claim 3, wherein the middle section of the protruding U-leg lies flush against one side of a projection in the button.

5. The switch arrangement of claim 4, wherein the other U-leg lies flush against other sections of the button.

6. The switch arrangement of claim 1, wherein the button is covered by a cap.

7. The switch arrangement of claim 1, wherein the button acts on a switch component that is arranged on a foil which extends into the switch housing.

8. The switch arrangement of claim 7, wherein a light source is formed by an LED disposed on the foil inside the switch housing and that at least one of the buttons and a switching mat is made from a translucent material.

9. The switch arrangement of claim 7, wherein the switch housing is constructed in two parts, where a component with the guide track is arranged on top of and fastened to a base component.

10. The switch arrangement of claim 1, wherein at least one light source is arranged inside the switch housing and that at least one of the buttons and a switching mat is made from a translucent material.

11. The switch arrangement of claim 1, wherein a resilient switching mat is arranged in the housing.

12. The switch arrangement of claim 11, wherein the switching mat is disposed directly on top of the foil.

13. The switch arrangement of claim 1, wherein the switch is a push button switch.

14. The switch arrangement of claim 2, wherein the spring is a piece of wire bent into a U-shape, which is held inside the button in the region of its U-base and of which the free end of one U-leg extends as far as the guide track; the guide track, which is under the protruding U-leg'original position in which the switch arrangement is in the OFF position, is formed by a heart-shaped block, of which the apex of heart is at the top and the recess of heart is at the bottom, and an associated triangular convex under the recess; the top of the block is to the lower left and the bottom of the block is to the lower right of the protruding U-leg's original position.

15. The switch arrangement of claim 3, wherein the two legs of the U-shaped spring lie in the same plane and are perpendicular to the direction of sensing motion,

16. The switch arrangement of claim 15, wherein the protruding U-leg is in an unloaded state in one switching state and is deflectable in the plane of the U-legs as a result of the movement of the button along the guide track.

17. The switch arrangement of claim 3, wherein the protruding U-leg is under no tension in one switched state and would be deflected along the guide track as a result of the button movement.

18. The switch arrangement of claim 8, wherein when operated, the button would be pressed towards the switching mat, and the switching mat is resilient and would be configured to allow inward spring deflection more easily than outward spring deflection.

* * * * *